US007143680B2

(12) United States Patent
Bender

(10) Patent No.: US 7,143,680 B2
(45) Date of Patent: Dec. 5, 2006

(54) RECOIL AND MUZZLE BLAST DISSIPATOR

(76) Inventor: Terrence D. Bender, P.O. Box 240, Ridgeview Cir., Hamel, MN (US) 55340

( * ) Notice: Subject to any disclaimer, the term of this patent is extended or adjusted under 35 U.S.C. 154(b) by 26 days.

(21) Appl. No.: 10/811,537

(22) Filed: Mar. 29, 2004

(65) Prior Publication Data

US 2004/0244571 A1 Dec. 9, 2004

Related U.S. Application Data

(60) Provisional application No. 60/461,121, filed on Apr. 8, 2003.

(51) Int. Cl.
*F41A 21/00* (2006.01)

(52) U.S. Cl. ..... 89/14.3; 42/1.06

(58) Field of Classification Search ..... 42/1.06; 89/14.2, 14.3

See application file for complete search history.

(56) References Cited

U.S. PATENT DOCUMENTS

| | | | | | |
|---|---|---|---|---|---|
| 4,322,999 | A * | 4/1982 | Aston | 89/14.3 |
| 4,545,285 | A | 10/1985 | McLain | 89/14.3 |
| 4,869,151 | A * | 9/1989 | Chahin | 89/14.3 |
| 4,879,942 | A | 11/1989 | Cave | 89/14.3 |
| 4,930,396 | A * | 6/1990 | Johnson | 89/14.3 |
| 5,020,416 | A | 6/1991 | Tripp | 89/14.3 |
| 5,036,747 | A | 8/1991 | McClain, III | 89/14.3 |
| 5,092,223 | A | 3/1992 | Hudson | 89/14.2 |
| 5,119,716 | A * | 6/1992 | Bartolles | 89/14.3 |
| 5,367,940 | A * | 11/1994 | Taylor | 89/14.3 |
| 5,631,438 | A | 5/1997 | Martel | 89/14.3 |
| 5,814,757 | A * | 9/1998 | Buss | 89/14.3 |
| 6,578,462 | B1 | 6/2003 | Franchino et al. | 89/14.3 |
| 2003/0106416 | A1 | 6/2003 | Vais | 89/14.3 |
| 2003/0106417 | A1 | 6/2003 | Vais | 89/14.3 |
| 2003/0154849 | A1 * | 8/2003 | Breuer | 89/14.3 |
| 2005/0188829 | A1 * | 9/2005 | Hanslick et al. | 89/14.3 |

* cited by examiner

*Primary Examiner*—J. Woodrow Eldred
(74) *Attorney, Agent, or Firm*—Vidas, Arrett & Steinkraus, P.A.

(57) ABSTRACT

A recoil and muzzle blast dissipator may be attached to the barrel of a gun and may redirect propellant gasses. In one embodiment, a recoil and muzzle blast dissipater may include a body portion having an internal plenum and a plurality of vent slots, each vent slot having an aperture in communication with the internal plenum. Each successive vent slot may include an aperture that is larger in area than the aperture of the previous vent slot. An exterior tube may include a side port and may be arranged to overlay the body portion such that a portion of each vent slot is covered by the exterior tube, and a portion of each vent slot is in communication with the side port.

22 Claims, 8 Drawing Sheets

RECOIL AND MUZZLE BLAST DISSIPATOR

CROSS-REFERENCE TO RELATED APPLICATIONS

This application claims the benefit of U.S. Provisional Patent Application No. 60/461,121 filed Apr. 8, 2003, the entire contents of which are incorporated herein by reference.

BACKGROUND OF THE INVENTION

This invention relates to rifle muzzle brakes. More specifically, in at least one embodiment, the invention may comprise a felt-recoil and muzzle blast wave dissipator, which characteristics are complimentary and not mutually exclusive, especially employable on large caliber rifles.

Muzzle brake designs are generally known. As the power of modern shoulder fired rifles has risen, so too has it become necessary to control the felt-recoil to make them more comfortable to shoot and to reduce movement of the gun and thereby enhance quick target reacquisition for follow-on shots at the target.

Recoil is the rearward motion of the gun when the gun is fired. The physical process follows Newton's Law: for every action, there is an equal and opposite reaction. The recoil is the summed momentum exchange of two separate events that are closely spaced in time. First, the reaction (momentum exchange) to the acceleration of the fired bullet from the cartridge case, down, and finally out of the barrel. Second, the reaction (momentum exchange) of the rearward directed thrust developed at the muzzle when the hot propellant gases are ejected from the barrel's muzzle like a rocket motor's exhaust.

The recoil has these effects. The line-of-action of the recoil forces, following Newton's Law, is coincident with the barrel bore. If the rifle butt stock that is placed in the shooter's shoulder pocket is lower than the barrel's line-of-action, the offset distance creates a moment arm (torque arm), to which the recoil force is applied, developing a force couple, which tends to raise the rifle muzzle up with the pivot being the shoulder seat as the rifle recoils rearward. If the shooter holds the rifle very firmly and the upper torso is stiffened, the rifle muzzle will still rise, as the pivot now becomes the shooter's lower extremities with the force couple remaining the same, but having a longer moment arm.

Small caliber military arms have been designed, which mitigate the effect of an out-of-line butt stock by placing the butt stock in-line with the barrel. However well this design improves the controllability of recoil effects, it can never eliminate them. This is especially apparent when the shooter is prone. The rifle tends to stay on target, but the abuse suffered by the collarbone and shoulder can have irremediable outcomes as the recoil energy formerly absorbed by the shooter in the slowly rocking motion of the upper torso during standing or sitting is now absorbed more directly without the benefit of a large movement to spread the energy out over time. The amount of muzzle rise depends on the power of the caliber, the weight of the rifle, the posture of the shooter, and many other secondary factors.

The most adverse effect of recoil is loss of target acquisition during the shot and the added amount of time to reacquire the target prior to firing the next shot.

Gun designers have attempted to mitigate the above effects by attaching so-called muzzle brake devices to the barrels. The muzzle brake redirects high-pressure propellant gases ejected from the barrel's muzzle in thrust force vectors opposite to the recoil thrust vectors, namely to the rearward direction, to mitigate recoil, and/or upward, to reduce muzzle rise. Since some, or most, of the propellant gas is directed rearward in this manner, less gas is ejected forward, and so less recoil force is generated that requires counter-action. U.S. Pat. No. 5,020,416 to Tripp, incorporated herein by reference in its entirety, is a good example of the prior art as well as many simple devices prevalent today. However, the prior art does not address management of very large volumes of propellant gases issued from large caliber rifles.

The recoil problem described above is acerbated with larger rifle calibers like the .50 cal. BMG (Browning Machine Gun) that employ larger and heavier bullets and very large propellant powder charges that generate an extremely large muzzle blast that is immediately and painfully perceived by the ears and even felt directly on the body by those unfortunate enough to be situated too near.

Muzzle recoil braking techniques have been applied to rifles employing large caliber cartridges with mixed results. The designer must trade off recoil amelioration with back-blast amelioration. Some recoil brakes direct the largest portion of the propellant gases rearward generating forces in opposition to the recoil forces. However, this occurs at the expense of the shooter and the spotter situated nearby at the shooter's flank, both of which experience the back-blast shockwave as a punctuated and very loud noise, which of itself, can upset target reacquisition, and additionally may kick up debris lying on the ground nearby that can obscure the target area or give away the shooter's position. The subject invention describes a utility whereby these two recoil brake effects can be mitigated in a complimentary and not contradictory way with recoil braking.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

It is an objective of the subject invention to redirect the propellant gases ejected from the gun barrel muzzle of large caliber rifles to produce reaction vectored forces using the same propellant gas to counteract the recoil inertial forces of the accelerated bullet without developing an uncomfortable or unsettling shockwave at the shooter's position or the spotter's side-position.

In some embodiments, the subject invention accomplishes this using the following recoil brake features: a brake body that may be cylindrical in shape with certain simple machined features; a plenum or an in-line series of propellant gas plenums; a multiplicity of rearward facing laterally mirrored vectorizing vertical vent slots which may be progressively enlarged, rear to forward positioned; a multiplicity of gas exhaust orifices or apertures made by the same vectorizing vent slots that intersect the internal plenums; and a multiplicity of external plenums defined by the same vectorizing vent slots, with an exterior slotted tube for gas expansion and shockwave confusion.

The interior plenum(s) may collect supersonic propellant gases and stage them for sequential exhausting through transversely located and longitudinally spaced ports in the walls of the plenum(s). The gas follows, but sometimes advances, in front of the bullet after the bullet exits the barrel muzzle. The bullet exits the brake through an exit hole at the forward-most end, where some of the gas also exhausts. The gas that exhausts through the other orifices contributes a reverse-acting recoil force that tends to cancel out the recoil force by simple vector addition.

Once the propellant gas has entered the plenum(s), it may exhaust through the exhaust ports in the sides. The exhaust ports may vary in size from small to large, from a rearward position to a forward position within the brake. The exhaust ports may be made in the plenum walls by rearward slanted vertical vent slots machined in the outside of the brake body that intersect the plenum volume and make cuts in the plenum walls. These cuts, or port orifices, may be irregularly shaped due to the interfering shapes of the vertical slots and the plenum walls. The extent to which the depth of the slot cut extends into the plenum(s) may determine the size of the port orifice. The depth of these cuts goes from shallow in the rear, to deeper in the forward extreme; thereby creating port orifices that are smaller to larger in size from a rearward position to a forward position.

Gas exhausting through any one of these ports may be redirected to the rear, by the vectoring aspects of the rearward facing vertical slots in the outside of the brake body creating a forward directed thrust, by means of gas momentum transfer to the brake, which counteracts the rifle recoil force.

When the gas is at its highest pressure, it may encounter a first pair of laterally mirrored exhaust ports on either side of the brake plenum. The mirrored ports may be arranged to cancel out the vector components of lateral thrust, leaving the gun unmoved in the lateral directions. The high-pressure gas passes through a small orifice producing a metered amount of thrust proportional to the gas pressure and orifice cross-sectional area relationship. As the gas travels forward toward the exit of the brake plenum, the pressure of the gas drops as more gas may be bled out through each pair of successively spaced ports. Finally, when the gas exits the final pair of ports, it is at a lower pressure, but passes through a larger area so that the forces developed by the successive ports and vertical slots tends to be more equal than if the force relationship depended only on port orifice area. In any case, the volume of gas and its velocity may vary from lateral port pair to lateral port pair down the length of the brake. This longitudinal asymmetry has important ramifications discussed further below.

A further feature of several embodiments of the invention is the effect that the vertical slots may have on the supersonic gas exiting through the laterally mirrored slot pairs. The gas entering the plenum(s) may be traveling supersonically forward. The pressure may be relieved at the sides through the exhaust ports. The gas must change direction and in doing so it also exchanges momentum with the brake and thus with the gun. The gas may slam into a forward face of the vertically cut vent slots on the outer side of the brake port. When it does so, the gas stream may be forced to fan out and flatten from a narrow flow stream equal in size to the port orifice. This cools the flow with an effect discussed below. This fanned out jet of cooling hot gas leaves the slot areas. This cooling effect is enhanced by the turbulence generated by the irregularly shaped orifice holes. Across the width of the slot, progressing from the forward to the rearward sides, there develops a velocity gradient across the gas flow as the velocity is seen to go from a high value to a lower value, which tends to break up the coherence of any exhaust gas shock wave coming through the orifice.

A further feature of some embodiments of the disclosed invention is the addition of a slotted cylindrical tube welded to the outside of the brake body. The tube may slide over the brake body and be welded to the brake at forward and rearward positions. Two elongated slots or side ports of generally rectangular shape may be made in the sides, opposite and mirroring one another. The side ports expose the vertical rearward facing vent slots of the brake body to the outside and at the sides. The side ports may be narrower than they are long such that they conceal portions of the vent slots in the brake body at the top and bottom. This arrangement may result in small exterior plenums that have as an interior port, the interior plenum exhaust ports, and as an exterior plenum port, the tube slot defining a rectangular like port of slightly larger cross-section than the interior port.

An exterior plenum may function to further slow down the gas by partial containment and to disrupt the streamed flow of the exhausting gases as well as to direct them rearward for the recoil thrust cancellation effect. Recall that the forward-most vertical slot wall fans out the gas exiting the interior plenums. The upper and lower extremities of the flow fan may be intersected and disrupted by the confining walls of the tube on the top and bottom sides of the tube slot. This reshapes the flow pattern of the gas immediately exiting the vertical slots from a simple fan to a U-shaped pattern at the exit interface, where the base of the U-shape is in a forward position, flowing off of the forward-most face of the slot and streams forming the legs of the U-shape being the concentrated flow patterns at the top and the bottom. The effect is to further mix the flow shedding from the vertical slots and the tube slot, creating a concentrated disrupted flow stream that is characterized by varying velocity gradients in all reference planes.

The shape and turbulent mixing characteristics of the flow emanating from each exterior external brake port is a function of the flow velocity and volume of gas passing through the interior plenums. In general, as stated above, the resultant force generated by the exhausting gas tends to be equal for each vent, yet, because the velocities are different due to the position of the plenum orifices with respect to one another in the rearward, or forward sense, and the pressure drop of the propellant gas, the further the gas has traveled beyond the barrel muzzle, the flow pattern will appear different. The cumulative effect of all of the ports exhausting gas at nearly the same time but at different velocities is that no coherent shock wave front can form. Contrast this with the shock wave developed by the best conventional muzzle brakes and the advantages of this novel design will be more apparent. Any coalescence of individual shock fronts developing and adding is obviated by the generation of multiple turbulent eddies within all flows. The turbulence and time spent in disruptive energy dissipating flow patterns as the plenums fill, then empty, and quickly drop in pressure after the bullet ejection event, tends to cool the hot gases more quickly than if the flows were less disrupted. The cooling has the effect of shrinking the exhausted hot gas faster, further reducing shock waves that are either perceived as sound, or felt on the shooter's or spotter's body.

It was a further design objective to direct the recoil canceling gas thrust vectors to the sides of the rifle's position without stirring up debris lying in the immediate vicinity. Gas directed down would certainly stir up undesirable dust and debris that could interfere with the shooter or spotter's view of the target and/or give away the rifle's position. The better conventional brakes have a tendency to kick up dust and debris as the coherent shockwave passes over the ground in the immediate proximity of the brake and the rifle behind it. Since the subject invention does not generate a coherent shock wave, very little debris is stirred into the surrounding air.

The resulting inventive design is a muzzle brake for large caliber rifles that is comprised of two easily machined and welded metal components that allows for the quick and effective exhaustion of large volumes of propellant gas through variously sized, arranged, and force vectoring ports, which object has not been addressed by the prior art. This novel inventive design maximizes the generation of recoil canceling thrust vectoring forces, minimizes the shock wave effects exhibited in an amelioration of the sound report, and minimizes the lofting of ground-borne debris into the surrounding air at the shooter's position, all of which enhances the shooter's comfort and his ability to stay sighted on the target, or reacquire the target, for faster successive firings.

In one embodiment, a muzzle brake may comprise a body having a first end, a second end, an internal plenum space and a plurality of vent slots. Each vent slot may have an aperture in communication with the internal plenum space. The internal plenum space may comprise an elongate projectile path plenum having a central longitudinal axis and a plurality of enlarged serial plenums. A tubular cover may be arranged to overlay at least a portion of the body, the tubular cover having at least one side port in communication with at least one vent slot.

In another embodiment, a muzzle brake may comprise a body having a central longitudinal axis, a first end having an entrance aperture, a second end having an exit aperture, an internal plenum space and a plurality of vent slots, including a first vent slot and a second vent slot. Each vent slot may be oriented at a non-zero orientation angle to the central longitudinal axis of the body. Each vent slot may have an aperture in communication with the internal plenum space. A tubular cover may be arranged to overlay at least a portion of the body, the tubular cover having at least one side port in communication with at least one vent slot. The orientation angle of the first vent slot may be different than the orientation angle of the second vent slot.

In another embodiment, a muzzle brake may comprise a body having an internal plenum space, an entrance aperture, an exit aperture, a first group of vent slots and a second group of vent slots. Each vent slot may have an aperture in communication with the internal plenum space. A tubular cover comprising a wall portion, a first side port and a second side port may be arranged to overlay at least a portion of the body such that at least a portion of each vent slot is covered by the wall portion of the tubular cover. At least a portion of each vent slot of the first group of vent slots may be in communication with the first side port of the tubular cover, and at least a portion of each vent slot of the second group of vent slots may be in communication with the second side port of the tubular cover These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
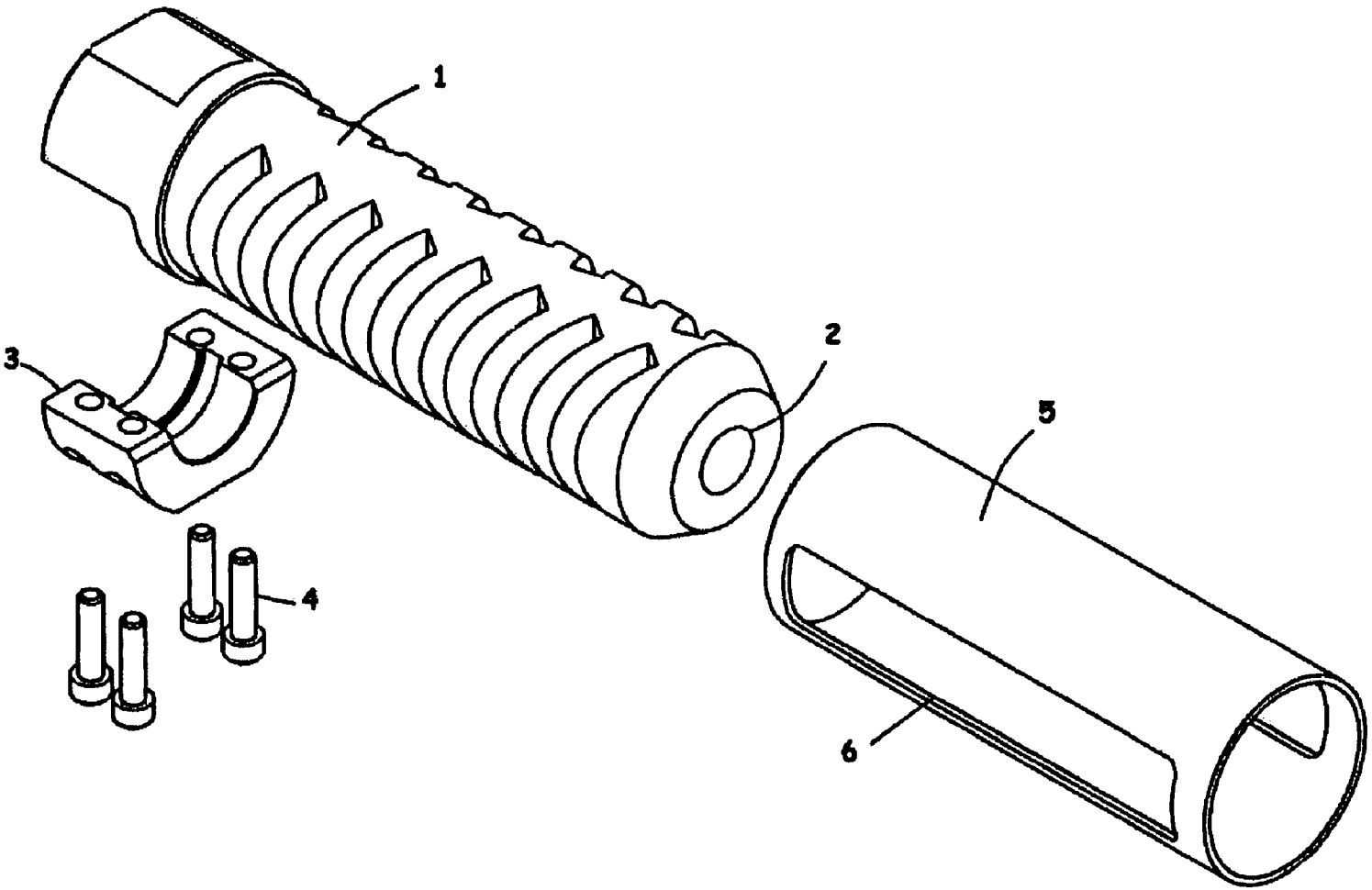
FIG. 1 is an isometric exploded view of an embodiment of an inventive muzzle brake showing the major components.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

The recoil brake of the subject invention may be rigidly attached to a barrel muzzle either by a conventional threading, clamp or other suitable attachment. An embodiment of the subject recoil brake is shown in FIG. 1, where body 1 and exterior tube or tubular cover 5 comprise the brake and can be of various lengths and diameter to length aspect ratio. A bullet exit 2 is shown, and one type of barrel muzzle attachment comprising a clamp 3 and clamp fasteners 4. The exterior tube 6 may include at least one side port or exhaust slot 6. An exhaust slot 6 may vary in aspect ratio, and may be arranged to control the lateral dispersion of exhaust gases exiting the muzzle brake. The body 1 may be machined in such a way that more structural material is evident in a rearward direction toward clamp 3 than in a forward direction toward bullet exit 2 to tolerate higher developed recoil forces toward the rear than the front as will be evident below.

Figure 2:
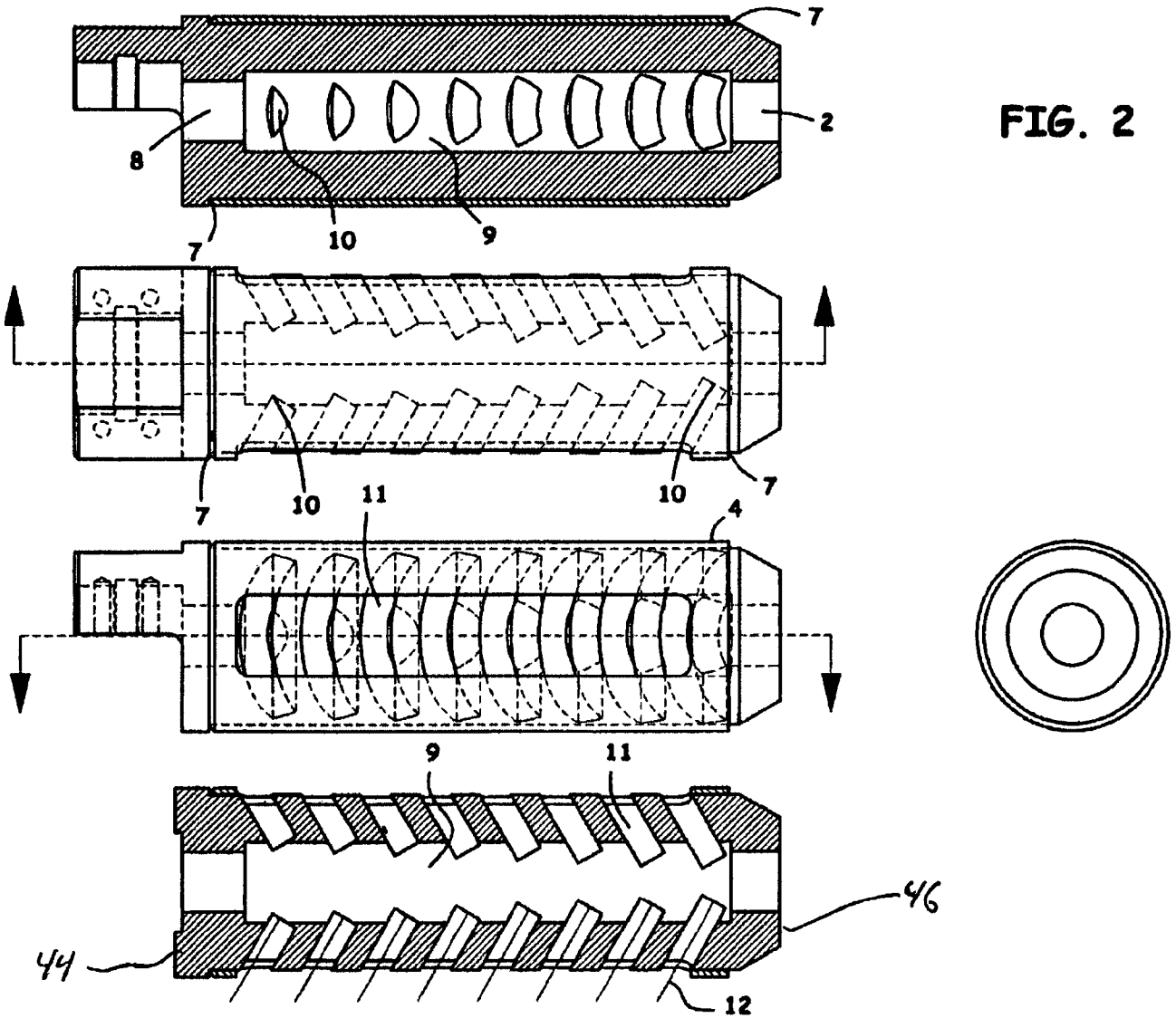
FIG. 2 shows three orthogonal views with respective cross-sections detailing the salient features of an embodiment of a muzzle brake with internally squared-off, parallel venting slots.

The exterior tube 5 may be rigidly attached to body 1 by any suitable method, for example by threading, swaging, crimping, pressing, adhesives, welding and the like. More specifically, welding may comprise assembly welds 7 in two circumferential places as shown in FIG. 2. Also evident are bullet exit 2 and bullet entrance 8, that in this embodiment are of equal diameter, but may not be equal, which diameters are always greater than and concentric with the rifle's barrel bore diameter. An internal plenum 9 may run the entire length of body 1 and may be of a greater diameter than bullet exit 2 and bullet entrance 8, and may be concentric with them. The body 1 may include a plurality of vent slots 11. Each vent slot 11 may extend through the body 1 in a predetermined height direction, such as a vertical direction. The depth that each vent slot 11 extends into the body 1 in a direction orthogonal to the height direction may increase from a first end 44 of the body 1 to a second end 46 of the body 1. Each vent slot 11 may include an aperture or exhaust port 10 which may be in communication with the internal plenum 9. Shown are several exhaust ports 10 which may be lateral exhaust ports of internal plenum 9 and can be of few or many in number, corresponding to the overall length of body 1, etc. Generally, one aperture or exhaust port 10 may be provided for each vent slot 11.

The size or area of an exhaust port 10 may increase from a rearward position nearest bullet entrance 8 to a forward position nearest bullet exit 2. Vent slots 11 may comprise square terminated vectorizing vent slots 11 and may progressively intersect internal plenum 9 by a greater amount from a rearward position to a forward position to create the progressively larger exhaust ports 10. Vent slots 11 may be of the same longitudinal spacing as shown, or may be of unequal spacing. The vertically oriented square terminated vectorizing vent slots 11 may be machined parallel to one another such that the exhaust vectors of the gas exiting square terminated vectorizing vent slots 11 would also be parallel as shown by the exhaust vector 12. The rearward rake angle of the square terminated vectorizing vent slots 11 can be varied from near zero, i.e., perpendicular to the longitudinal axis of body 1, or any suitable angle greater than zero, as shown in the Figures. The machining of vent slots 11 may be performed by any suitable means, such as by end milling or wire electrical discharge machining (EDM).

The tubular cover 5 may be positioned to overlay the body 1 such that a portion of each vent slot 11 is covered by the wall of the tubular cover 6, and a portion of each vent slot 11 is in communication with an exhaust slot or side port 6. Vent slots 11 may also form secondary external plenums in conjunction with exterior tube 5 as described below.

Figure 3:
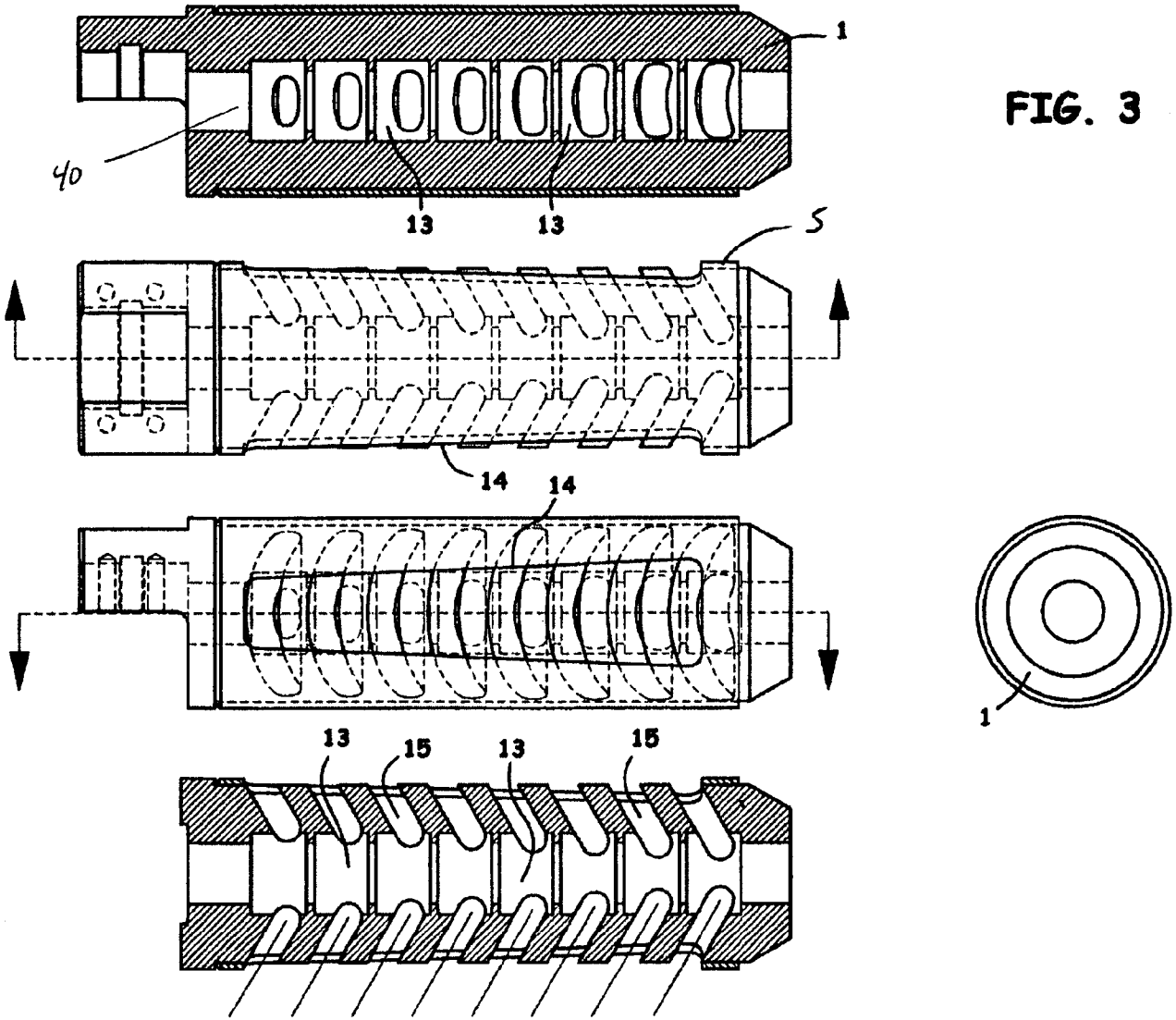
FIG. 3 shows three orthogonal views with respective cross-sections detailing the salient features of another embodiment of a muzzle brake with parallel slot features that have circular inward terminations.

FIG. 3 shows another embodiment of an inventive muzzle brake wherein an internal plenum space may comprise an elongate projectile path plenum 40 and a plurality of internal serial plenums 13. Each serial plenum 13 may be enlarged compared to the elongate projectile path plenum 40, for example by having a larger diameter. A pair of vent slots may be provided for each serial plenum 13. Vent slots may comprise round terminated vectorizing vent slots 15, wherein the vent slots 15 may terminate with a full radii instead of being square. An exterior tube 5 may include at least one side port or exhaust slot 6, which may comprise a tapered exhaust slot 14. Vent slots 15 in the body 1 and exhaust slots 6 in the exterior tube 5 may be formed by end milling or wire EDM. Notice that exhaust vector 12 may be unchanged from the embodiment of FIG. 2.

Figure 4:
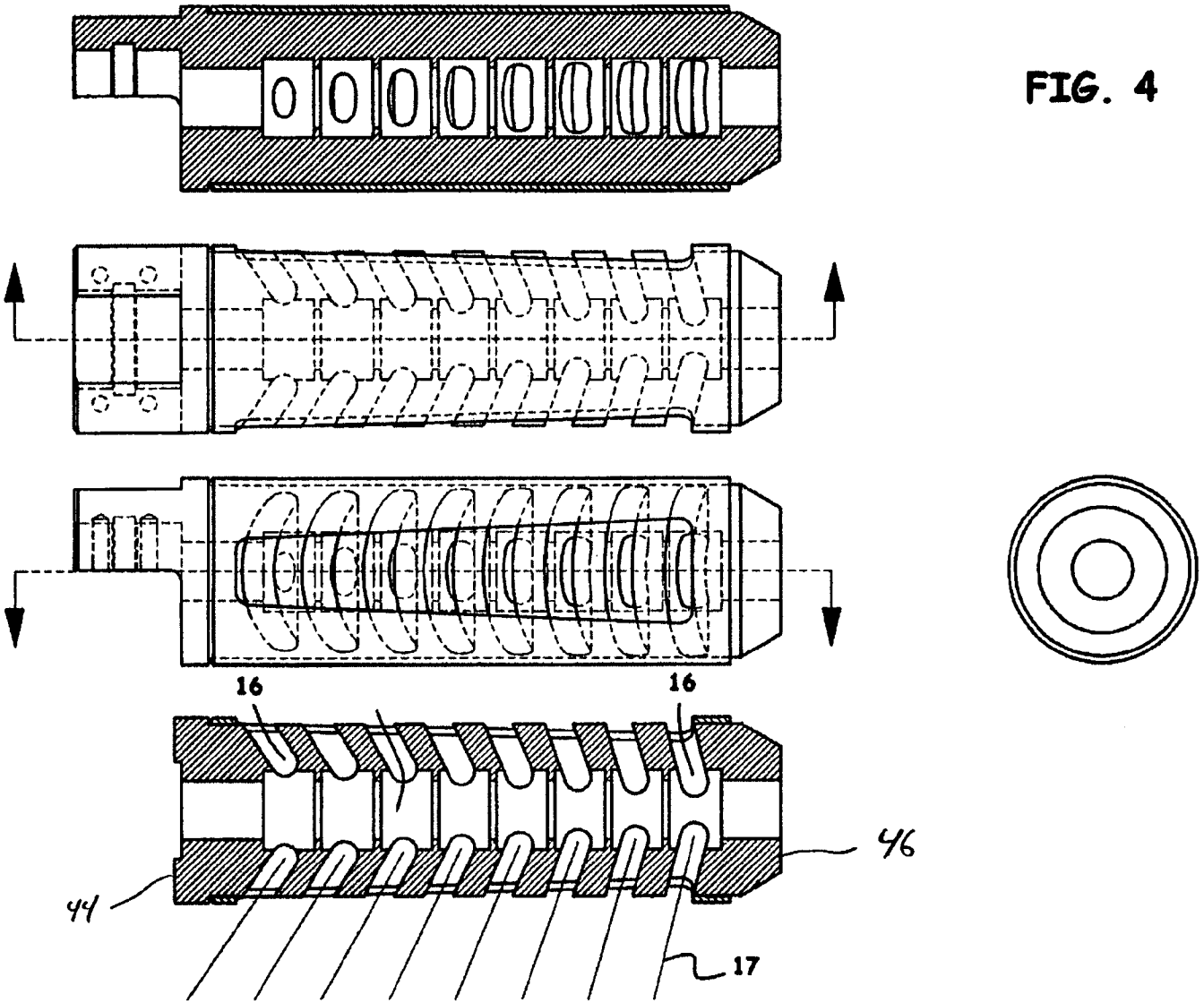
FIG. 4 shows three orthogonal views with respective cross-sections detailing the salient features of another embodiment of a muzzle brake with slot features that are externally divergent and that have circular inward termination shapes.

FIG. 4 shows another embodiment of an inventive muzzle brake, wherein the vent slots may collectively comprise divergent vectorizing vent slots 16. The rake angle or orientation angle of the divergent vectorizing vent slots 16 may decrease from the first end 44 of the brake to the second end 46 of the brake. Thus, the exhaust vectors 17 created by adjacent divergent vent slots are not parallel. Diverging the exhausting propellant gases may serve to alter sound shock waves by asymmetric turbulent mixing of exhaust gases.

Figure 5:
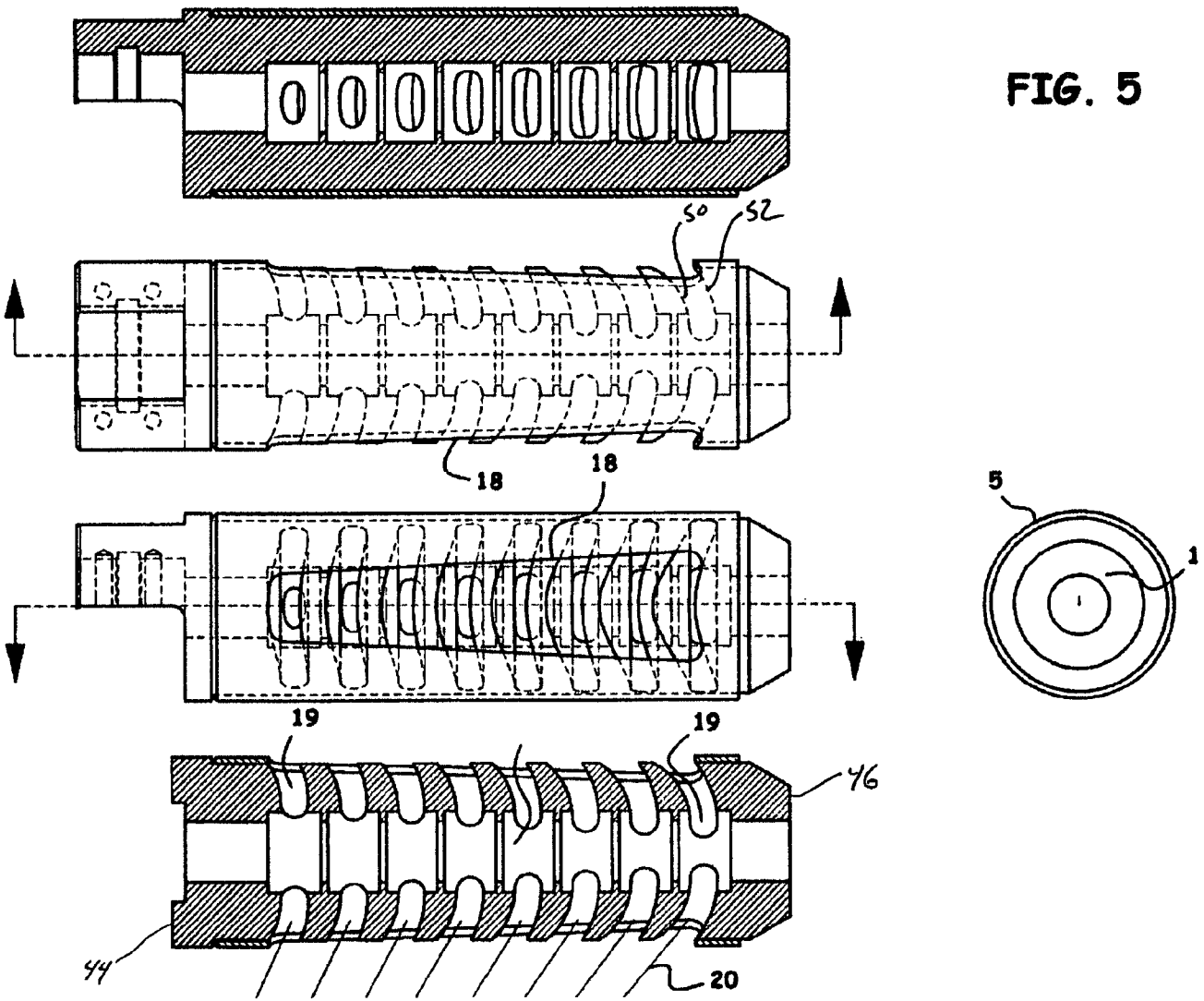
FIG. 5 shows three orthogonal views with respective cross-sections detailing the salient features of another embodiment of a muzzle brake with slot features that are curved rather than straight and are externally convergent and that have circular inward terminations.

FIG. 5 shows another embodiment of an inventive muzzle brake, wherein the vent slots may comprise patterned vent slots 18 having curvature. Each vent slot 18 may include a first side 50 and a second side 52. Both the first side 50 and the second side 52 may include curvature or be nonplanar. Curvature may be two-dimensional or three-dimensional. Thus, the wall of a vent slot may have curvature in a vertical direction, a horizontal direction, or both horizontal and vertical directions. Further, the degree of curvature of the first side 50 may be different than the degree of curvature of the second side 52.

Vent slots 18 may increase in curvature from the first end 44 of the brake to the second end 46 of the brake. Further, the first side 50 of each vent slot 18 may increase in curvature more rapidly from the first end 44 of the brake to the second end 46 of the brake than the second side 52 of each vent slot 18. Thus, the vent slots 18 may increase in volume and/or area from the first end 44 of the brake to the second end 46 of the brake. In some embodiments, at least a portion of the first side 50 and at least a portion of the second side 52 of a vent slot may comprise concentric circles having a common theoretical center point. A common theoretical center point may be located within the bounds of the muzzle brake, or may be located external to the muzzle brake.

The vent slots 18 may collectively comprise convergent vectorizing vent slots 18. The rake angle of the convergent vectorizing vent slots 18 may increase from the first end 44 of the brake to the second end 46 of the brake. Thus, the exhaust vectors 20 created by adjacent divergent vent slots are not parallel, and the exhaust vectors 20 created by adjacent vent slots 18 may eventually cross or overlap, causing the exhaust gasses exiting adjacent vent slots 18 to converge. Converging the exhausting propellant gases may serve to alter sound shock waves.

Figures 6A, 6B, 6C:
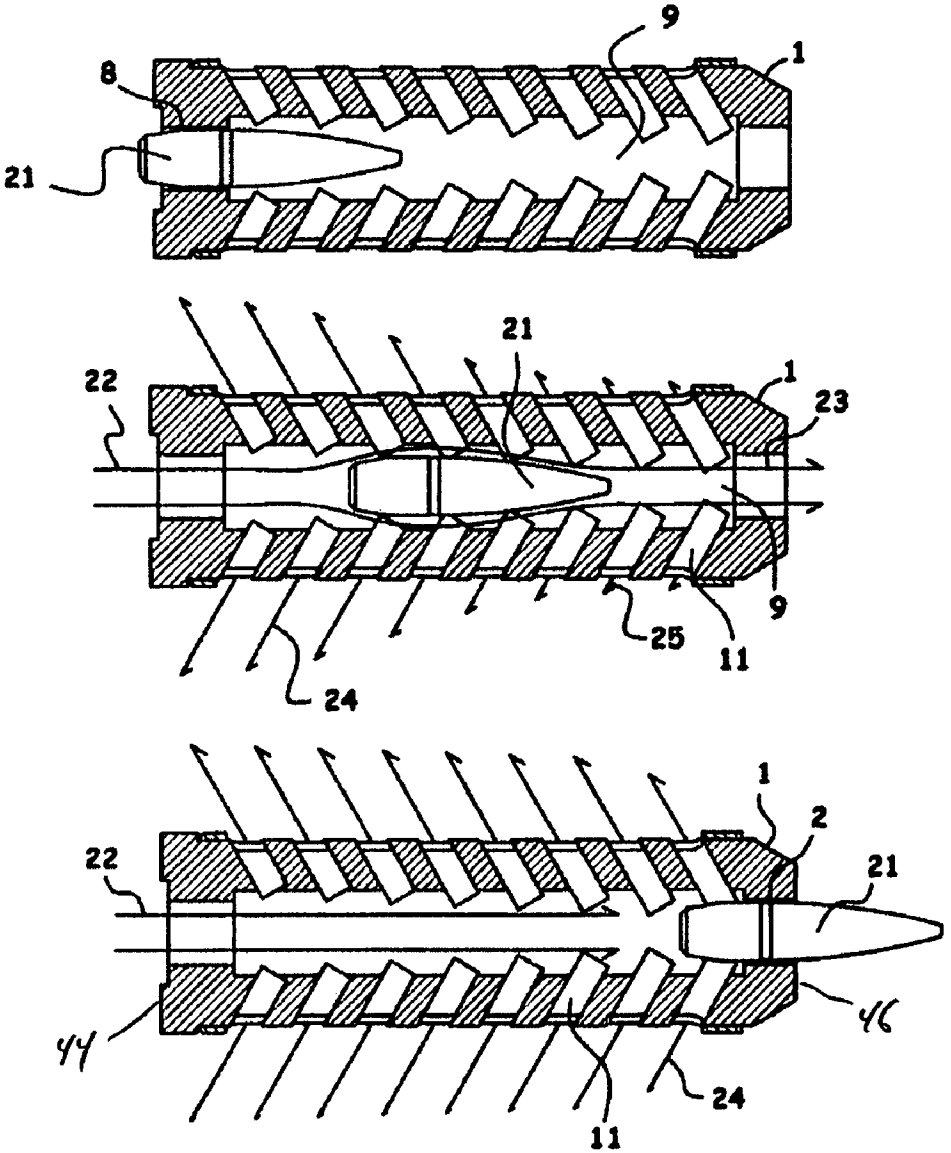
FIG. 6*a* shows the sequential progress of a bullet as it travels the length of an embodiment of a muzzle brake in a beginning position.
FIG. 6*b* shows the same bullet in a more progressive position.
FIG. 6*c* shows a still more progressive bullet position, showing how the propellant gas is distributed among the several exhaust port orifices from a single internal gas plenum. The views shown are horizontal cross-sections of the exemplary design shown in FIG. 2.

FIG. 6*a* shows a first position in a sequence of a bullet 21 fired from a gun having an embodiment of an inventive muzzle brake. The bullet 21 may enter the body 1 at the bullet entrance 8. At this point in time, the bulk of the propellant gas may be located behind the bullet 21.

In FIG. 6*b*, the bullet 21 has passed through the body 1 far enough that some of propellant gas 22 begins to supersonically exhaust through a plurality of vent slots 11. Notice that due to the internal diameter of internal plenum 9, some propellant gas bypass 23 may supersonically pass by bullet 21 that is traveling at a slower relative speed and actually partially vent as propellant gas exhaust bypass 25, forward of bullet 21's position. However, most of gases that are now exhausting do so as propellant gas exhaust 24. The relative length of the parallel vectors shown as arrows in propellant gas exhaust 24 and propellant gas exhaust bypass 25 indicate the timing, and hence volume, or velocity, of gas, where the longer arrows represent more established flows in terms of time, higher volume, and velocity.

The view in later time, shown in FIG. 6*c*, denotes the relative velocities, or volumes, of exhaust gases propellant gas exhaust 24 when the bullet 21 is exiting body 1 through bullet exit 2. For all practical purposes, the high pressure propellant gas exhaust 24 must exit the brake through the vent slots 11. Even after the bullet 21 has completely exited bullet exit 2 and no longer obstructs propellant gas 22, the relative opening size of bullet exit 2 is small compared to the total collective opening size of all of the vent slots 11, so that most of the available gas is still exchanging momentum with the muzzle brake, where that portion that exits through bullet exit 2, contributes very little recoil effect.

The effect of progressively larger exhaust ports 10 in the vent slots 11 from a first end 44 of the brake to the second end 46 is best shown in FIG. 6*c*. When the propellant gas 22 is at its highest pressure near the first end 44 of the brake, it may encounter a first pair of laterally mirrored vent slots 11 on either side of the brake plenum. The mirrored vent slots 11 may be arranged to cancel out the vector components of lateral thrust, leaving the gun unmoved in the lateral directions. The high-pressure gas may pass through relatively small apertures associated with the first vent slots, producing a metered amount of thrust proportional to the gas pressure and aperture cross-sectional area relationship. As the gas travels forward toward the bullet exit 2, the pressure of the gas 22 drops as more gas may be bled out through each pair of successively spaced vent slots 11. Each successive pair of vent slots 11 will receive gas 22 at a lower pressure than the previous pair of vent slots. Each successive pair of vent slots 11 may include larger apertures in communication with the internal plenum space than the previous pair of vent slots. Thus, the forces developed by the successive vent slots 11 tend to be more equal to one another than if all of the vent slots included apertures of a similar size. The volume of gas and its velocity may vary from lateral port pair to lateral port pair down the length of the brake. In some embodiments, the high pressure gas and small apertures near the first end 44 leading to lower pressure gas and larger apertures near the second end 46 create adjacent vent slots 11 which may each experience an equal amount of reactive force.

Figure 7A:
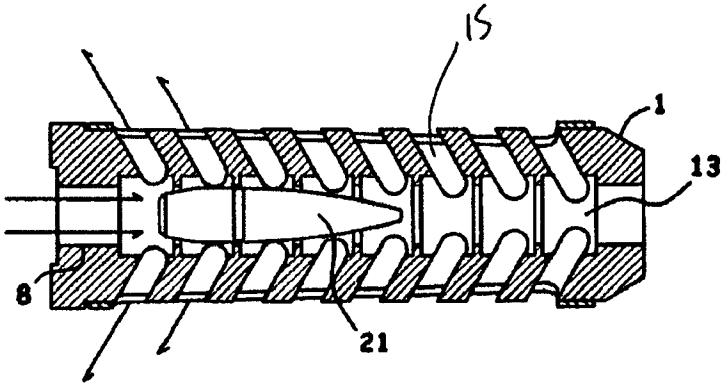
FIG. 7*a* shows the sequential progress of a bullet as it travels the length of another embodiment of a muzzle brake in a beginning position.

FIG. 7*a* shows a first bullet position in another sequence with an alternative embodiment having a body 1 comprising internal serial plenums 13. The bullet 21 has passed through the bullet entrance 8. At this point in time, the bulk of propellant gases may be located behind the bullet 21.

Figure 7B:
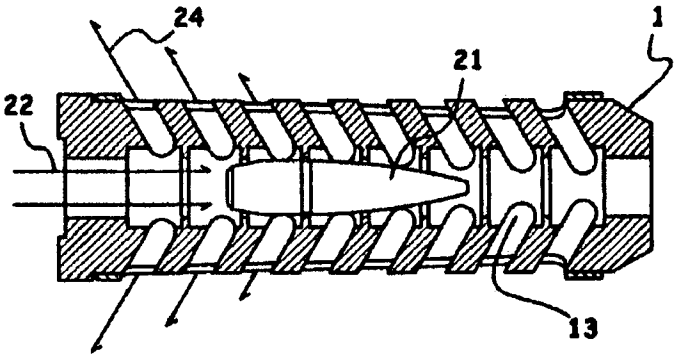
FIG. 7*b* shows the same bullet in a more progressive position.

In FIG. 7*b*, the bullet 21 has passed through the body 1 far enough that some of the propellant gas 22 begins to exhaust as propellant gas exhaust 24 through vent slots 15. However, unlike the sequence shown in FIGS. 6*a*, 6*b*, and 6*c*, the internal diameter of internal plenum space changes according to the internal serial plenums 13. This has the effect of forcing all of the gas behind the bullet 21 through those ports behind bullet 21, as there is no space between the bullet 21 and the partition walls of the internal serial plenums 13 for gas passage. The relative length of the parallel vectors shown as arrows in propellant gas exhaust 24 indicate the timing, and hence volume, or velocity, of gas, where the longer arrows represent longer flows in terms of time, higher volumes, and higher velocity.

Figure 7C:
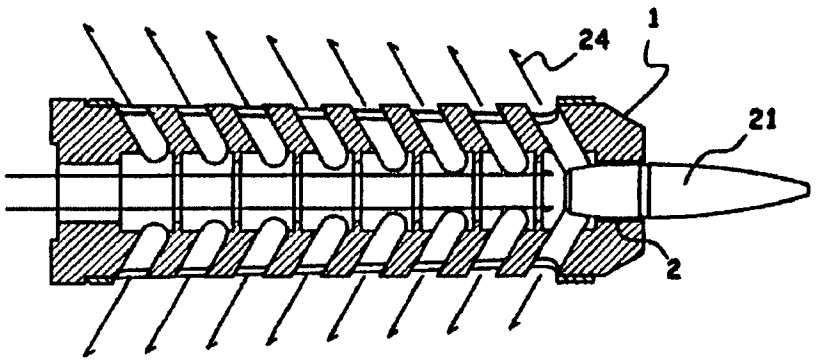
FIG. 7*c* shows a still more progressive bullet position, showing how the propellant gas is distributed among the several exhaust port orifices from a multitude of sequential internal gas plenums. The views shown are horizontal cross-sections of the exemplary design shown in FIG. 3.

The last sequenced view in time shown as FIG. 7*c* shows the relative velocities, or volumes, of exhaust gases propellant gas exhaust 24 when bullet 21 is exiting body 1 through bullet exit 2. For all practical purposes, the high pressure propellant gas exhaust 24 must exit the brake through vent slots 15. Even after the bullet 21 has completely exited the bullet exit 2 and no longer obstructs propellant gas exhaust 24, the relative opening size of bullet exit 2 is small compared to the total opening size of all of the vent slots 15, so that most of the available gas is still exchanging momentum with the muzzle brake, where that portion that exits through bullet exit 2, contributes very little recoil effect.

Figure 8B:
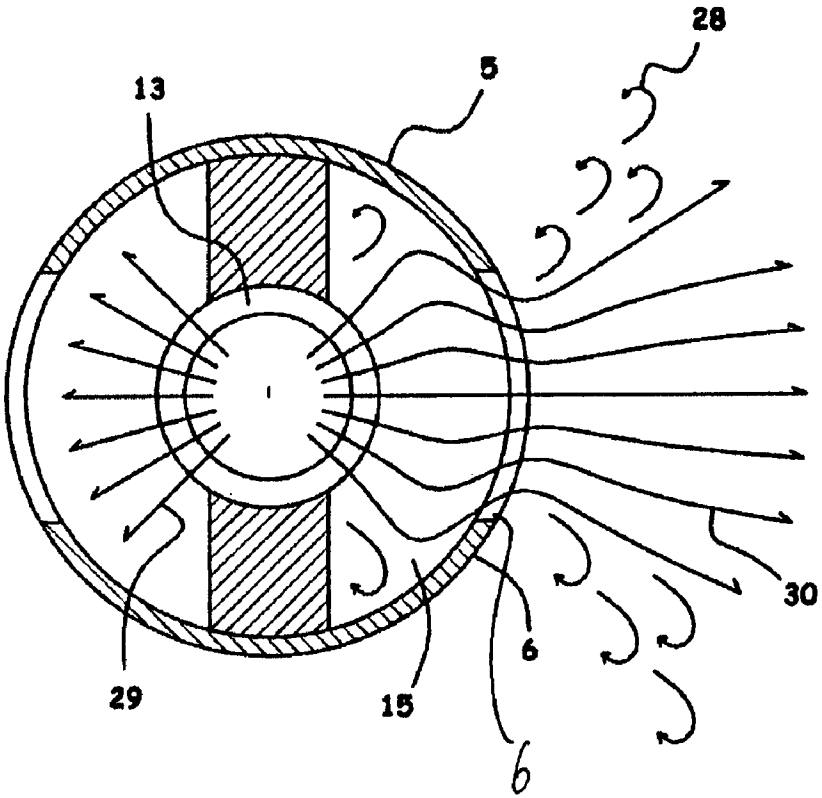
FIG. 8*b* is a vertical cross-section, perpendicular to the longitudinal axis of the same exemplary design shown in FIG. 3 and FIG. 8*a*.
Figure 8A:
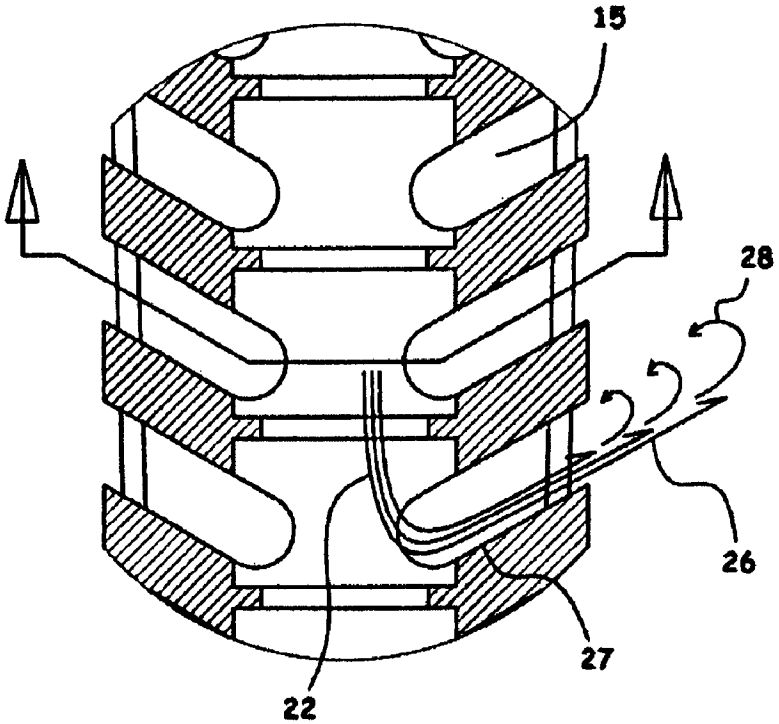
FIG. 8*a* shows how the features within an embodiment of a brake direct the gas streams to effect momentum exchange and shock wave confusion. The view of FIG. 8*a* is an enlargement of a horizontal cross-section shown in FIG. 3.

FIG. 8*a* shows how a propellant gas stream 26, after redirection of propellant gas 22, exits though vent slots 15 and exchanges momentum with the muzzle brake and causes a reduction in recoil force as it compresses against the forward slot wall forming a propellant gas fan 27. The greater the rake angle of said vent slots 15, the greater the momentum exchange, and also the sound blast felt and heard by the shooter or spotter nearby. The location of higher velocity gas in the propellant gas stream 26 is shown as longer arrow lines that are closer to the forward most face of the vent slot 15. This causes a steep velocity gradient and generates exhaust turbulence 28, such as turbulent eddies. Exhaust turbulence 28 may cool the exhaust gas and reduce the coherence of the shock wave that is perceived by the shooter as sound. The exhaust turbulence may also reduce the lofting of debris on the ground in the vicinity of the rifle's muzzle.

FIG. 8*b* shows a volume of gas in a plane perpendicular to the axis of the muzzle brake. On the left hand side is shown a blast of propellant gas fan 29 just behind the bullet that has just entered one of the internal serial plenums 13. It begins to fan out prior to impinging on the inside of exterior tube 5. On the right hand side of FIG. 8*b* is shown the changes in the path that hypothetical gas particles may travel to exit through an exhaust slot 6 of an exterior tube, which may also generate exhaust turbulence 28. A portion of the propellant gas fan 29 may be impinged against the wall of the exterior tube 5. Thus, at least a portion of each vent slot may comprise a secondary external plenum space. Propellant gas within a secondary external plenum space may be redirected and may eventually pass through an exhaust slot 6. Venting propellant gas 30 may fan out a second time external to the exterior tube 5, causing rapid cooling and confusion of coherence in the gas flow that may reduce the sound. Exhaust turbulence 28 that is generated may be three-dimensional and may be a function of several factors based partially the exact embodiments of vent slots and exhaust slots used, and the relative dimensional aspect ratios of each.

Gas exhausted through the muzzle brake may sequentially pass through internal serial and concentric plenums and external plenums formed by the vent slots and exterior tube 5. An interference pattern may be generated whereby the developed sound waves cancel one another out based on a variation of said machined geometries, which may reduce the magnitude of blast wave experienced by a shooter and spotter.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A muzzle brake comprising:

a body having a first end, a second end, an internal plenum space and a plurality of vent slots, each vent slot comprising a first planar side and a second planar side, each vent slot having an aperture in communication with the internal plenum space, the internal plenum space comprising an elongate projectile path plenum having a central longitudinal axis and a plurality of enlarged serial plenums; and a tubular cover arranged to overlay at least a portion of the body, the tubular cover overlaying a portion of each vent slot, the tubular cover having at least one side port oriented over a plurality of vent slots.

2. The muzzle brake of claim 1, wherein a central longitudinal axis of each enlarged serial plenum lies along the central longitudinal axis of the elongate projectile path plenum.

3. The muzzle brake of claim 1, wherein the aperture of each vent slot is in communication with an enlarged serial plenum.

4. The muzzle brake of claim 1, wherein each of said enlarged serial plenums has a constant diameter along its length.

5. The muzzle brake of claim 1, wherein each vent slot is oriented at a non-zero orientation angle to the central longitudinal axis of the elongate projectile path plenum, and wherein the orientation angle of a vent slot increases from the muzzle brake first end to the muzzle brake second end.

6. The muzzle brake of claim 1, wherein each vent slot is oriented at a non-zero orientation angle to the central longitudinal axis of the elongate projectile path plenum, and wherein the orientation angle of a vent slot decreases from the muzzle brake first end to the muzzle brake second end.

7. The muzzle brake of claim 1, wherein the tubular cover is fixedly attached to the body.

8. The muzzle brake of claim 1, wherein the side port in the tubular cover increases in size from a first end to a second end.

9. The muzzle brake of claim 1, wherein two vent slots are provided for each enlarged serial plenum.

10. The muzzle brake of claim 1, wherein the area of each vent slot aperture in communication with an enlarged serial plenum increases from the muzzle brake first end to the muzzle brake second end.

11. The muzzle brake of claim 1, further comprising a first group of vent slots and a second group of vent slots, each group of vent slots having at least one vent slot in communication with each enlarged serial plenum.

12. The muzzle brake of claim 11, wherein a vent slot of the first group of vent slots that is in communication with a first enlarged serial plenum comprises a mirror image of a vent slot of the second group of vent slots that is in communication with the first enlarged serial plenum.

13. The muzzle brake of claim 11, wherein the cover comprises a first side port and a second side port, the first side port oriented over a portion of each vent slot of the first group of vent slots, the second side port oriented over a portion of each vent slot of the second group of vent slots.

14. The muzzle brake of claim 1, the vent slots comprising a plurality of first vent slots and a plurality of second vent slots, the tubular cover further comprising a first elongate obstruction portion, a second elongate obstruction portion a first elongate side port and a second elongate side port;

wherein the first elongate obstruction portion overlays a portion of each first vent slot, the second elongate obstruction portion overlays a portion of each second vent slot, the first elongate side port is oriented over a portion of each first vent slot and the second elongate side port is oriented over a portion of each second vent slot.

15. A muzzle brake comprising:

a body having a first end, a second end, an internal plenum space and a plurality of vent slots, each vent slot having an aperture in communication with the internal plenum space, the internal plenum space comprising an elongate projectile path plenum having a central longitudinal axis and a plurality of enlarged serial plenums; and a tubular cover arranged to overlay at least a portion of the body, the tubular cover having at least one side port in communication with at least one vent slot;

wherein at least one vent slot further comprises a first side and a second side, the first side being nonparallel to the second side.

16. A muzzle brake comprising:

a body having a central longitudinal axis, a first end having an entrance aperture, a second end having an exit aperture, an internal plenum space and a plurality of vertically oriented vent slots, each vent slot raked toward said first end, each vent slot having a planar side oriented at an acute orientation angle with respect to the central longitudinal axis of the body, each vent slot having an aperture in communication with the internal plenum space; and a tubular cover arranged to overlay at least a portion of the body, the tubular cover overlaying a portion of each vent slot, the tubular cover having at least one side port oriented over a plurality of vent slots.

17. The muzzle brake of claim 16, wherein each vent slot passes through the entire height dimension of the body in the area of the vent slot.

18. The muzzle brake of claim 16, wherein a horizontal depth dimension of each vent slot increases from the muzzle brake first end to the muzzle brake second end.

19. The muzzle brake of claim 16, wherein the orientation angle of each vent slot planar side increases from the muzzle brake first end to the muzzle brake second end.

20. The muzzle brake of claim 16, wherein the orientation angle of each vent slot planar side decreases from the muzzle brake first end to the muzzle brake second end.

21. The muzzle brake of claim 16, wherein the area of each vent slot aperture in communication with the plenum space increases from the muzzle brake first end to the muzzle brake second end.

22. A muzzle brake comprising:

a body comprising an internal plenum space, an entrance aperture, an exit aperture, a first group of vent slots and a second group of vent slots, each vent slot having opposed first and second sides defined by the body, each vent slot having an aperture in communication with the internal plenum space; and a tubular cover comprising a wall portion, a first side port and a second side port;

wherein the tubular cover is arranged to overlay at least a portion of the body such that at least a portion of each vent slot is covered by the wall portion of the tubular cover, the wall portion of the tubular cover abuts an area of the body located between vent slots, at least a portion of each vent slot of the first group of vent slots is in communication with the first side port of the tubular cover, and at least a portion of each vent slot of the second group of vent slots is in communication with the second side port of the tubular cover.

* * * * *